US007628200B2

(12) United States Patent
Guidry

(10) Patent No.: US 7,628,200 B2
(45) **Date of Patent: *Dec. 8, 2009**

(54) TUBULAR RUNNING TOOL AND METHOD OF USING SAME

(76) Inventor: Mark L. Guidry, 104 Midland Dr., Lafayette, LA (US) 70506

( * ) Notice: Subject to any disclaimer, the term of this patent is extended or adjusted under 35 U.S.C. 154(b) by 0 days.

This patent is subject to a terminal disclaimer.

(21) Appl. No.: 12/080,023

(22) Filed: Mar. 31, 2008

(65) Prior Publication Data

US 2008/0245575 A1 Oct. 9, 2008

Related U.S. Application Data

(63) Continuation of application No. 11/124,471, filed on May 6, 2005, now Pat. No. 7,350,586.

(51) Int. Cl.
*E21B 19/06* (2006.01)

(52) U.S. Cl. ..... 166/77.52; 175/85

(58) Field of Classification Search ..... 175/85; 166/77.52, 77.51, 380
See application file for complete search history.

(56) References Cited

U.S. PATENT DOCUMENTS 3,342,520 A * 9/1967 Haynes ..... 294/90
4,489,794 A * 12/1984 Boyadjieff ..... 175/85
4,793,422 A * 12/1988 Krasnov ..... 175/57
5,294,228 A * 3/1994 Willis et al. ..... 414/22.55
5,297,833 A * 3/1994 Willis et al. ..... 294/102.2
6,920,926 B2 * 7/2005 York et al. ..... 166/77.1
7,350,586 B2 * 4/2008 Guidry ..... 166/380
2004/0256110 A1 * 12/2004 York et al. ..... 166/379
2005/0098352 A1 * 5/2005 Beierbach et al. ..... 175/57
2006/0000601 A1 * 1/2006 Pietras ..... 166/77.53

* cited by examiner

*Primary Examiner*—Hoang Dang
(74) *Attorney, Agent, or Firm*—Matthews, Lawson & Bowick PLLC

(57) ABSTRACT

An automated tubular running tool for use in drilling systems and the like allows for the picking up, positioning, stabbing and threadedly connecting a tubular segment to a tubular string being held by the rig by a spider. The tool comprises a pivoting arm, which can pickup, position, stab and threadedly connect the tubular segment. The tool further features an integral elevator, which then lowers the piping string tubing string into the well bore. This tubular running tool allows for the connection of tubular segments to a tubular string without the need of personnel.

6 Claims, 10 Drawing Sheets

TUBULAR RUNNING TOOL AND METHOD OF USING SAME

RELATED APPLICATION

This application is a continuation application related to U.S. patent application Ser. No. 11/124,471, filed on May 6, 2005, for Casing Running Tool and Method of Using Same, patented on Apr. 1, 2008 as U.S. Pat. No. 7,350,586.

TECHNICAL FIELD

This invention relates to well drilling operations and more particularly to a device for assisting in the assembly of tubular strings, such as, but not limited to, casing, drill pipe strings, production tubing, and the like.

BRIEF DESCRIPTION OF DRAWINGS

For a further understanding of the nature and objects of the present invention, reference should be made to the following brief description, taken in conjunction with the accompanying drawings, in which like elements are given the same or analogous reference numbers.

DETAILED DESCRIPTION OF THE PREFERRED EMBODIMENTS OF THE INVENTION

It is well known in the art that the drilling, completion, and production of wells typically involves assembling tubular strings, such as casing, drill pipe, production tubing, and the like, each of which comprises a plurality of elongated tubular segments extending downwardly from a rig into the well bore.

These strings may comprise large diameter tubulars, and therefore very heavy tubular segments.

The conventional manner in which plural tubular segments are coupled together to form a tubular string is a labor intensive method, typically involving the use of a stabber and casing tongs. The stabber may be a person or may be a manually controlled device to insert a segment of tubular into the upper end of an existing tubular string. The tongs are designed to engage and rotate the segment to threadedly connect to the tubular string. While such a method is effective, it is very cumbersome, labor intensive, relatively inefficient, and therefore costly. The procedure is typically done manually, includes a casing crew, and is extremely dangerous to the personnel performing such method. Furthermore, using casing tongs may require a setting up of scaffolding and other like structures, thus adding to the inefficiency. The entire operation of attaching tubular segments to the tubular string, the use of the casing tongs and the stabber produces a hazardous environment which has, at times, resulted in death or serious injury to the drilling rig personnel. Therefore, the industry and the art are in need of an efficient tool and/or method to assemble tubular strings together and lower such strings into a well bore utilizing a minimal amount of personnel in close contact or in the danger zone around the rig operation.

Figure 1:
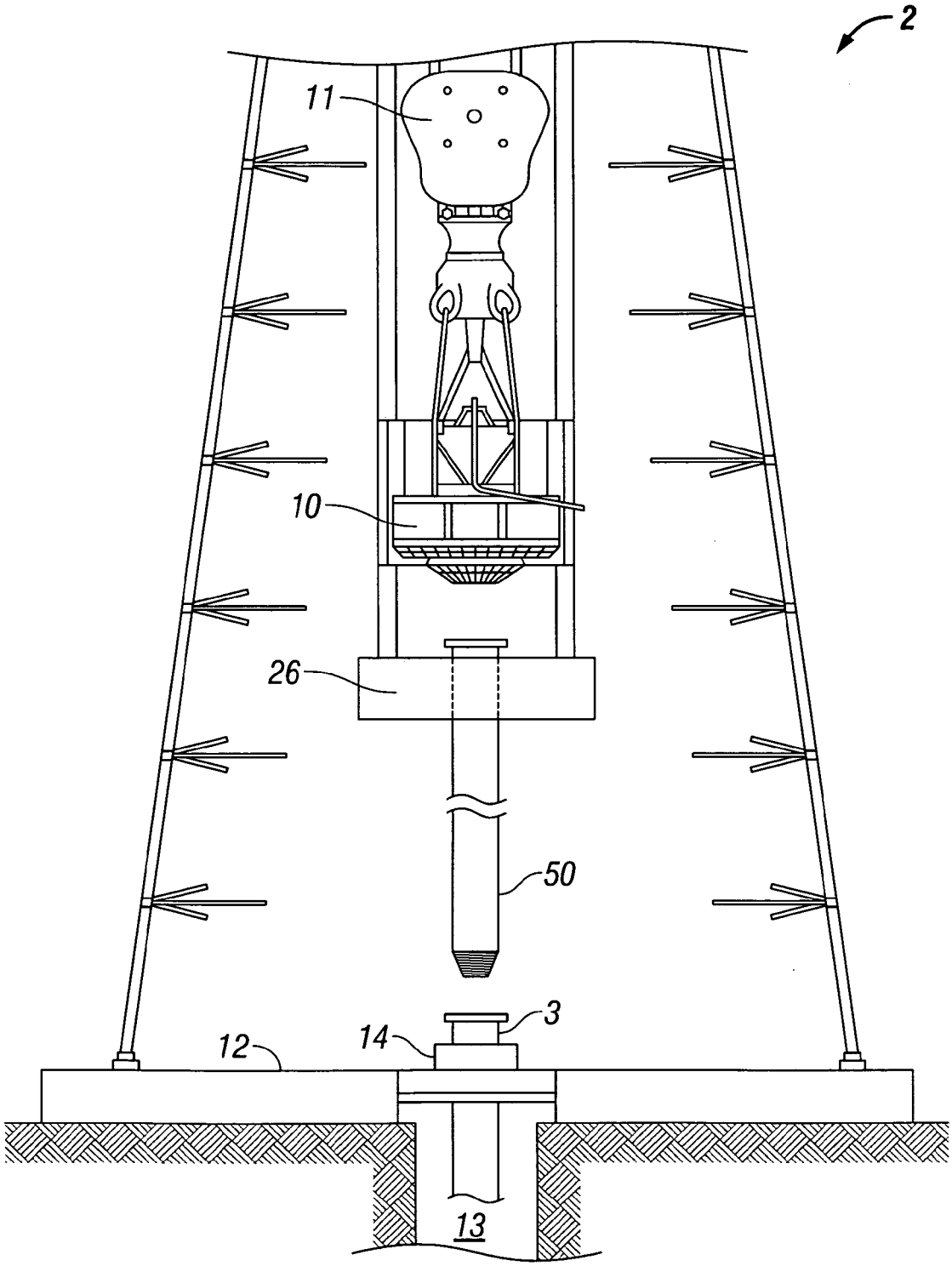
FIG. 1 illustrates a conventional drilling rig, known in the prior art, utilizing a spider to hold a lowered casing string in position.

FIG. 1 illustrates a conventional drilling rig 2 in the process of assembling a tubular string and lowering such string downhole into a borehole or wellbore 13. Typically the tubular assembly and lowering operation involves an elevator 26 which lowers the tubular string 3, a traveling block 11 which allows the elevator to travel in a vertical direction, and a drive unit 10, which can provide any desired rotation to the tubular string 3. It should be noted that the drive unit 10 may be a conventional rotary type drive or may be conventional top drive unit or any other type of drive unit. A conventional sequence for assembling a tubular string 3 may be as follows. A lowered tubular string 3 is suspended by the spider 14. A new tubular section 50 is lifted onto the rig floor 12 and is positioned so as to be attached to the elevator 26 or prior to the attachment of the elevator 26 to be stabbed into the existing tubular string 3. Once the new tubular segment 50 is stabbed into the existing tubular string 3, tongs or other rotatable tools (not illustrated), rotate the new tubular segment 50 until it is threadedly engaged with the existing tubular string 3 being held and supported by the spider 14. Next, the elevator 26 grips the new tubular segment 50, now threadedly engaged into the tubular sting 3. The spider 14 then releases the grip on the tubular string 3. The elevator 26 lowers the tubular string 3 to a certain level, at which point the spider 14 again grips the tubular string 3 and then the process is repeated.

Figure 2:
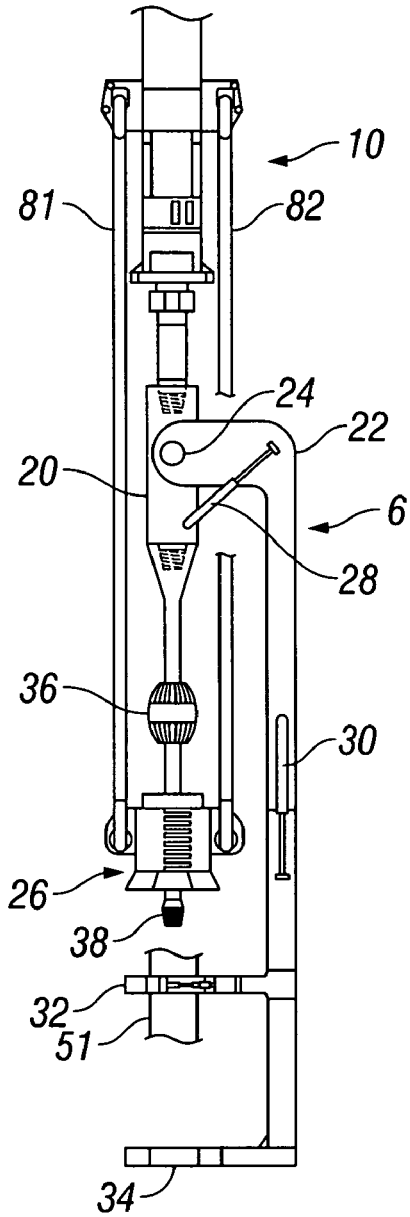
FIG. 2 illustrates an elevated side view, partially in cross-section, of an embodiment of the running tool according to the present invention.
Figure 2:
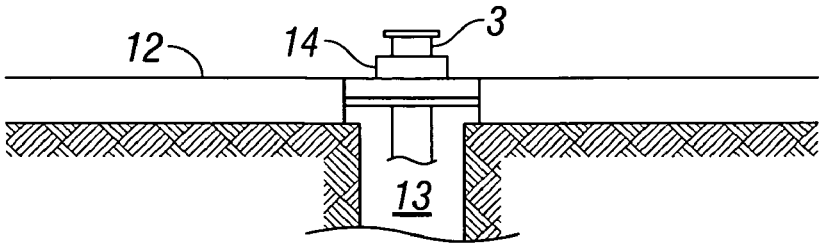
Figure 3:
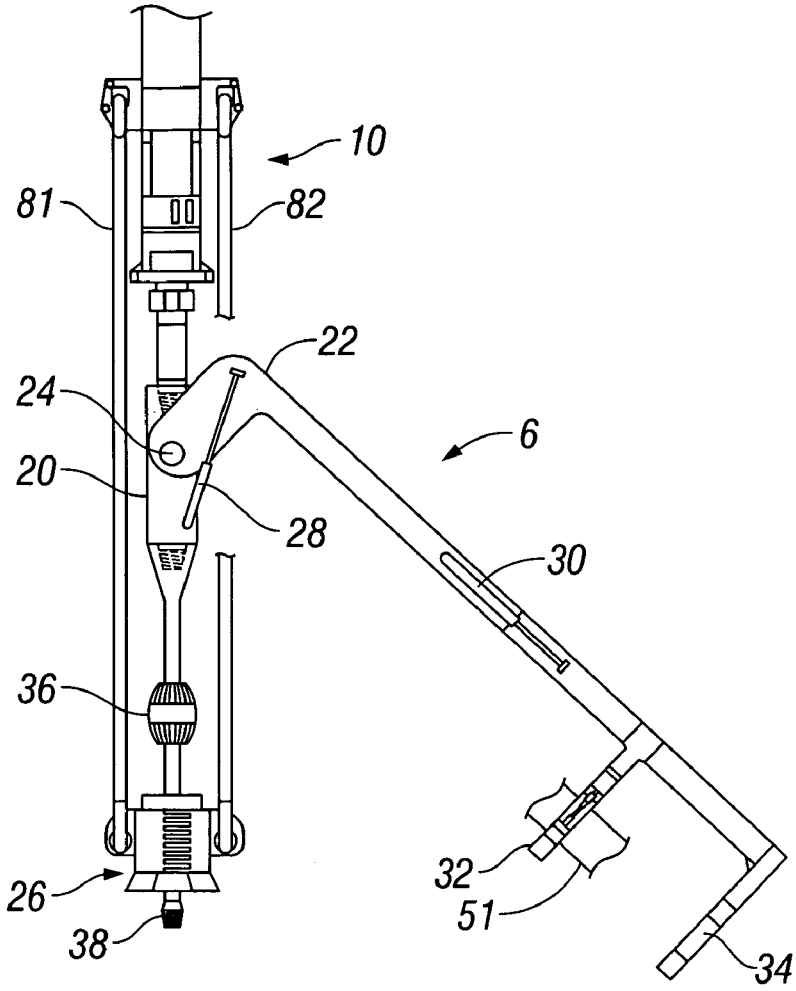
FIG. 3 illustrates an elevated side view, partially in cross-section, of an embodiment of the running tool with a single joint elevator and tong portion swung away according to the present invention.
Figure 3:
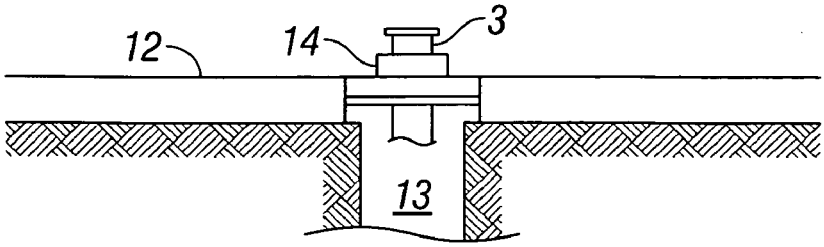
Figure 3A:
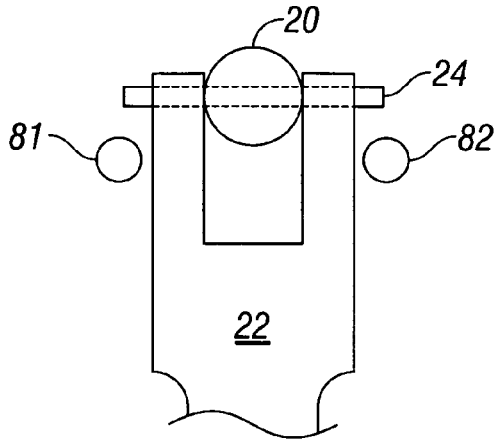
FIG. 3*a* illustrates a top view of an embodiment of a yoke type attachment of the running tool arm according to the present invention.
Figure 5:
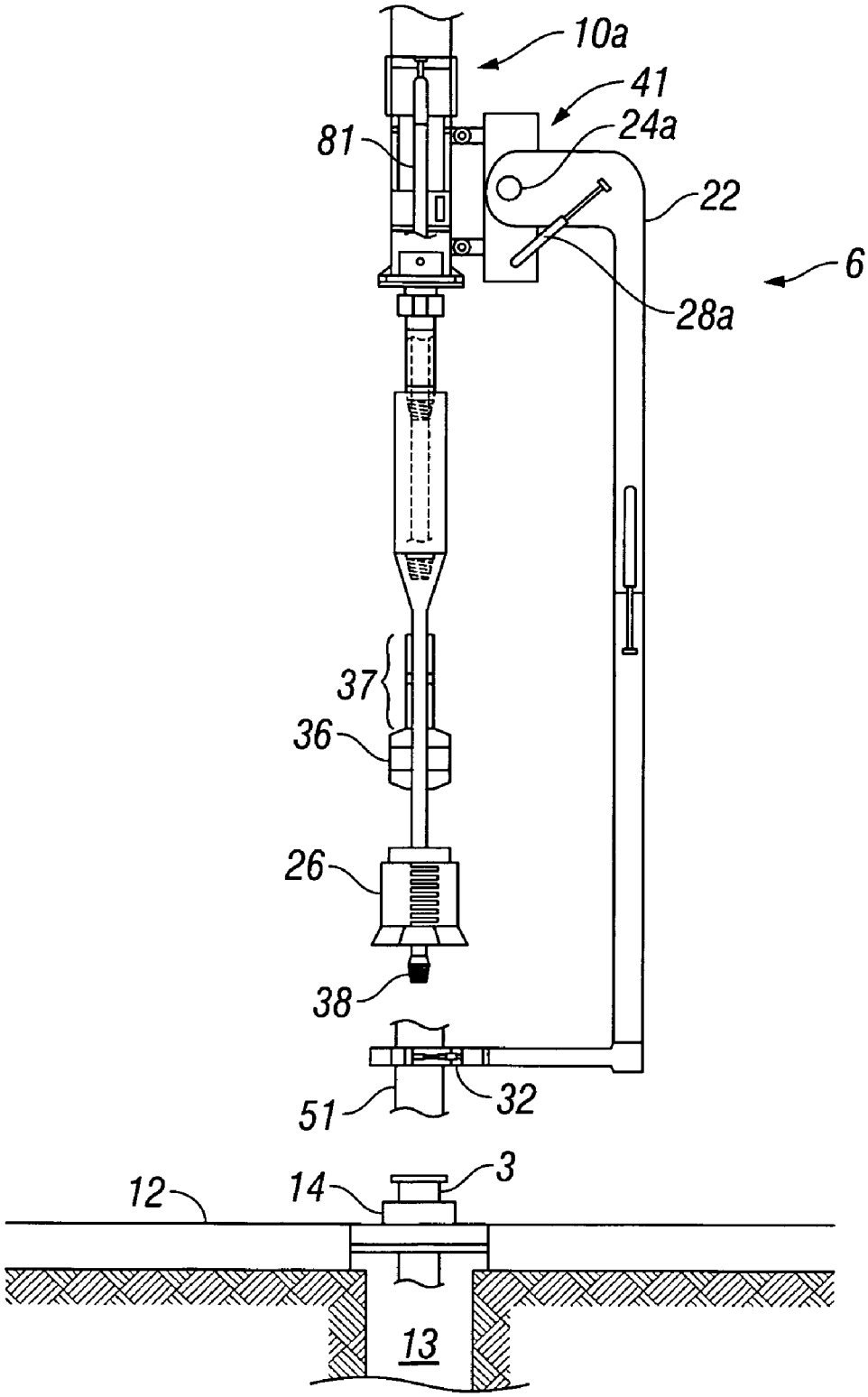
FIG. 5 illustrates an elevated side view, partially in cross-section, of another embodiment of the running tool according to the present invention.
Figure 6:
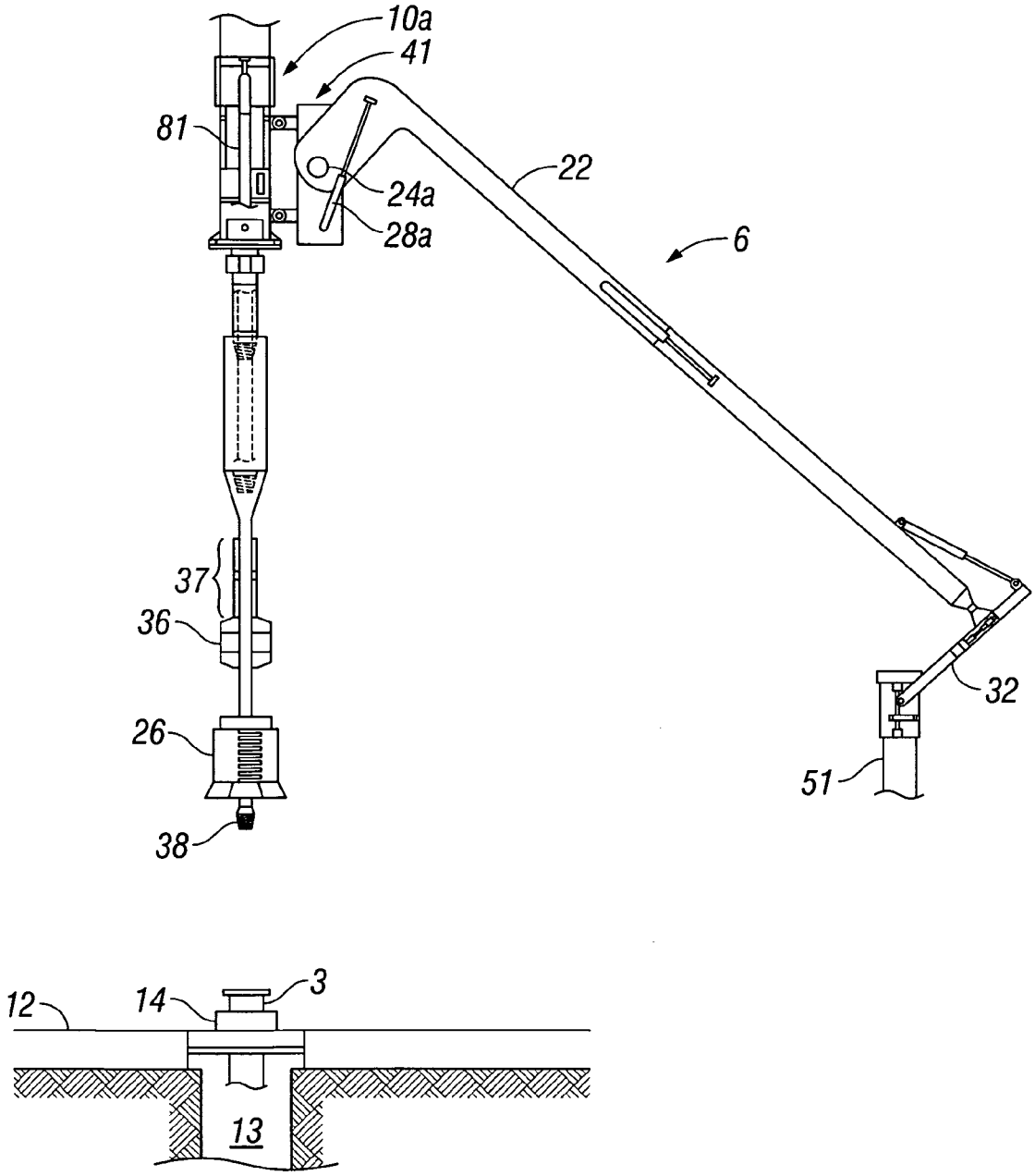
FIG. 6 illustrates an elevated side view, partially in cross-section, of another embodiment of the running tool with a single joint elevator and tong portion swung away according to the present invention.
Figure 8:
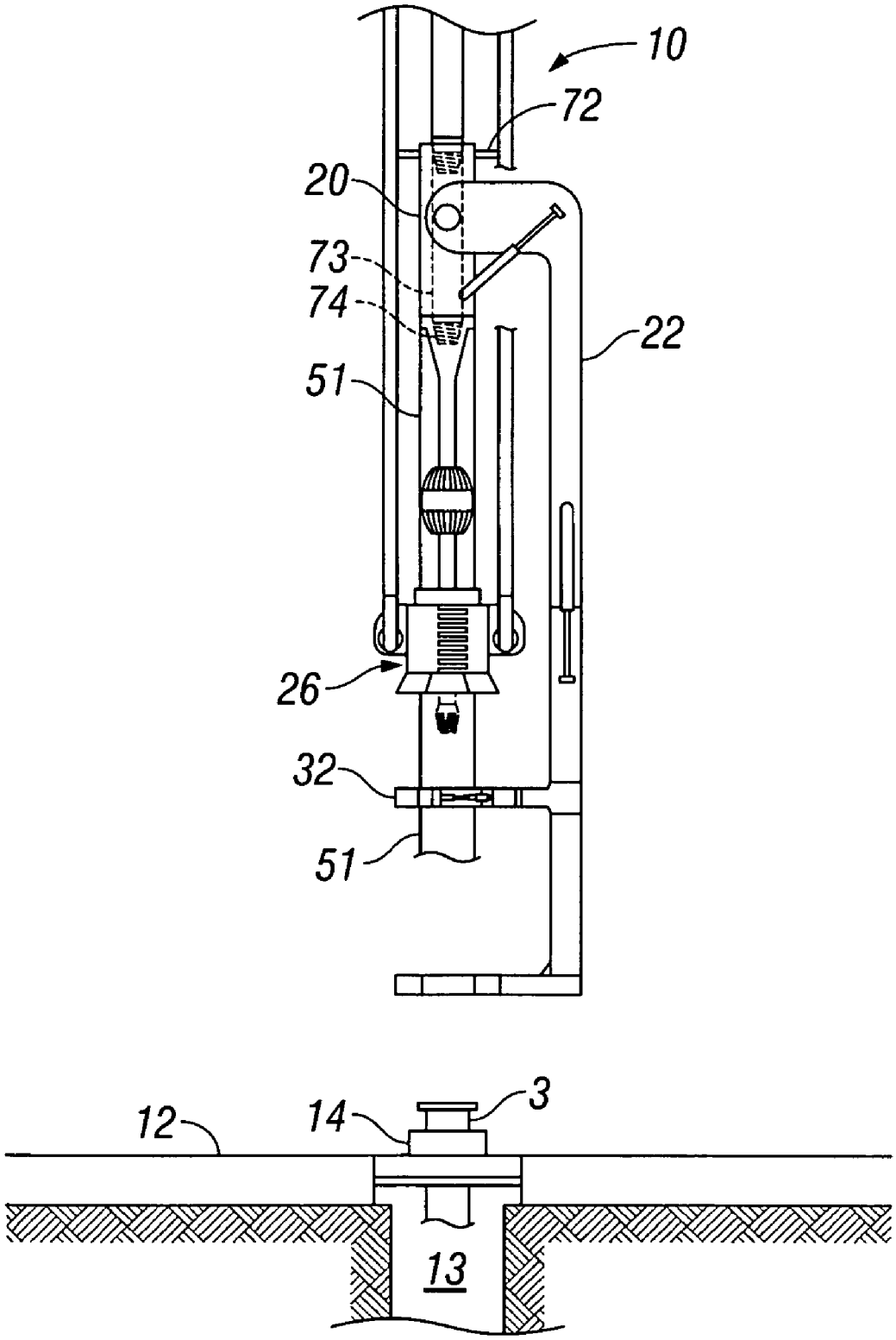
FIG. 8 illustrates an elevated side view, partially in cross-section, of an another embodiment of the running tool according to the present invention.

It should be appreciated that FIGS. 2, 3, and 8 are primarily to illustrate how the various parts of the running tool 6 are put together. However, in actuality, arm 22 is mounted so as to extend out from between the bails B1, B2. Thus, as illustrated in these figures, arm 22 pivots about pivot point 24 so as to move out from the page or back into the page. However, FIGS. 5 and 6 illustrate the correct orientation of the running tool 6 with respect to the bails B1, B2. FIGS. 5 and 6 show the position of bail, B1 with respect to the running tool 6. The connection point or pivot point 24 for arm 22 is preferably a yoke type assembly as illustrated in FIG. 3A. However, various other methods of connections should not be viewed as a limitation thereof.

Referring now to FIG. 2 an improved running tool, general designated with the numeral 6, is shown attached below the drive unit 11. It should be understood that the term running tool should not be viewed as a limitation of this tool and that the present running tool can be utilized for running casing, tubing, drill pipe, and a variety of other tubulars. It should be appreciated that the drive unit 11 can be a conventional top drive, a rotary drive, or any other type of rig drive mechanism. It should be further understood, by those in the art, that when connecting the running tool 6 to the drive unit 11, further connections are provided to allow the flow of drilling fluid through the subs which connect the drive unit 11 and the running tool 6 and further through the running tool 6 and into the tubular string 3 being lowered into the well bore 13. Preferably, running tool 6 comprises a pipe sub 20 which supports the pickup arm 22. Pickup arm 22 is preferably hingedly attached to pipe sub 20. Preferably, the pickup arm 22 and the pipe sub 20 are assembled away from the rig. However, the place of assembly should not be viewed as a limitation herein. It should be appreciated that the pickup arm 22 is movably attached so as to allow rotation of the arm 22 about a pivot connection 24, so as to align with the elevator 26, in a vertical relationship, or to move out of alignment, with elevator 26 to allow unobstructed vertical movement of the elevator 26. It should be appreciated that the pickup arm 22 can be attached by conventional attachments, such as, pins, bolts, welding, clamps, bearings, and any other feature that would allow a pivotable moveable attachment. The pickup arm 22 is preferably actuated through the use of hydraulic pistons 28. It should be understood that the pistons 28 may be hydraulic, pneumatic, electric, or any combination thereof. If should further be understood that the movement of pickup arm 22 can be achieved by means other than the pistons illustrated herein and should not be viewed as a limitation thereof.

It should be appreciated that elevator 26 is, at least indirectly, connected to the top drive 11 by bales B1, B2. It should be further appreciated that any other conventional attachment of the elevator 26 to a rig top drive can be utilized. It should still further be appreciated, from the figures, that the arm 22 forms a substantially channel like shape from the pivot point 24 to the distal end of the elevator 32. It should be understood that this distinctive shape is still utilized in alternative embodiments such as illustrated in FIGS. 5 and 6 and whether the running tool 6 comprises an integral tong 34 or not. It should still further be understood that this channel like geometry allows the pickup arm 22 to align the gripped tubular segment 51 with the elevator 26 and the tubular string 3 (or the wellbore 13) substantially through only a vertical movement of the pickup arm 22 while pivoting about the pivot 24.

Figure 4:
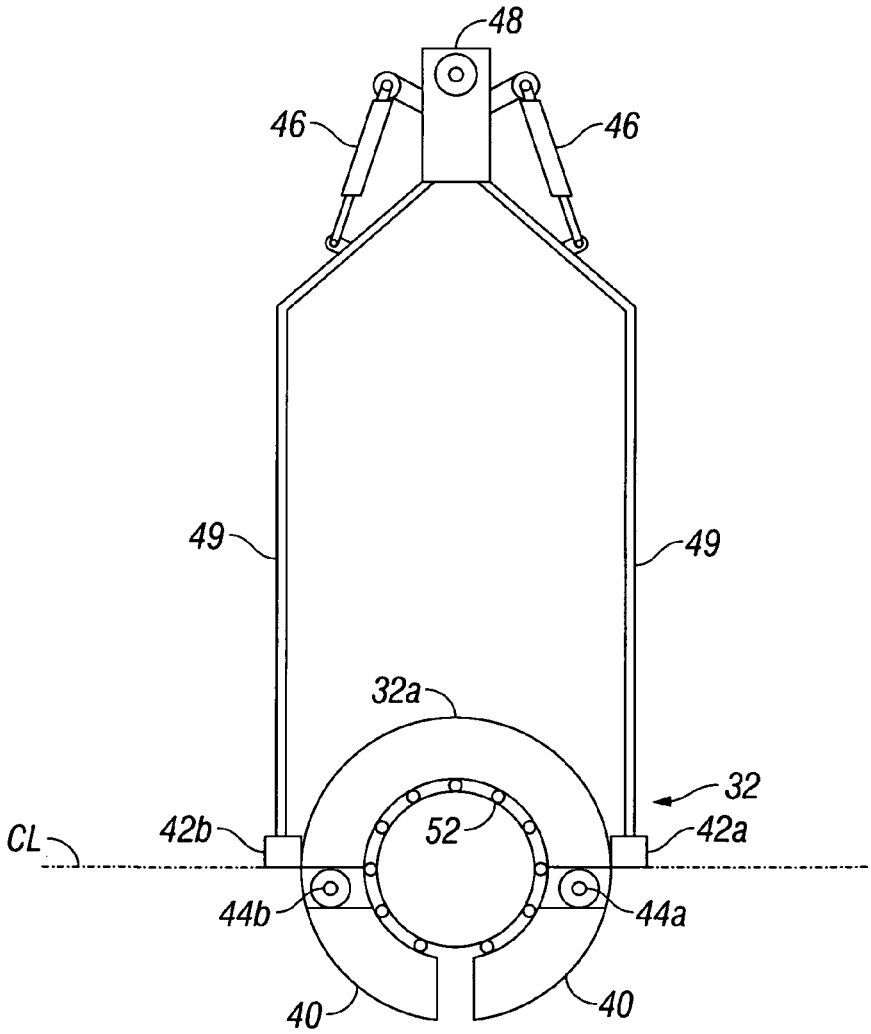
FIG. 4 illustrates in greater detail the single joint elevator portion of the running tool according to the present invention.

Still referring to FIG. 2, the pickup arm 22 preferably is constructed so as to telescope outwardly or downwardly and can be comprised of two or more substantially parallel arms (see FIG. 4). Preferably pickup arm 22 extends and retracts via one or more cylinders 30. It should be appreciated that cylinders 30 can also be pneumatic, hydraulic, electronic, or any combination therein and further that the extension and retraction of the pickup arm 22 should not be viewed as being limited only to actuation by pistons. It should be further appreciated that the pickup arm 22 can be of two sections or multiple sections, with each section or some of the sections telescoping. Near the lower end of the pickup arm 22, distal from pipe sub 20 is preferably a hydraulic elevator 32 and below that a tong 34. It should be appreciated that the pickup arm 22 may be used without the tong 34. There may be preferences, among rig owners, operators, or even casing crews as to the use of a tong 34 integral to the pickup arm 22 or separate conventional tongs. It should be further appreciated that when a tong 34 is utilized, there may still exist a need for conventional backup tong (not illustrated). It should be appreciated that elevator 32 can also be a conventional single joint elevator. However, it should be further appreciated that if elevator 32 is a single joint elevator, the rotation of tubular segment 51 may be with a great deal more friction than in the preferred hydraulic elevator 32 with cam followers 52. Thus, making the hydraulic elevator 32 preferable for the makeup operation.

Typically, if a flush mounted spider is being used in conjunction with running the tubulars, a backup tong will not be required. However, other spider configurations may require the use of backup tongs particularly for the first several tubular joints being assembled until there is enough suspended tubular string weight to prevent the rotation of the tubular string while the next tubular segment is being coupled to the tubular string.

Referring now to FIG. 3, pickup arm 22 is pivoted about pivot point 24 so as to pick up tubular segment 51. It should be appreciated by those in the art, that tubular segment 51 is typically picked up from the V-door. Tubular segment 51 is picked up by the single joint elevator 32 from the V-door or other pipe positioning area or device. After elevator 32 has positively gripped tubular segment 51, arm 22 is again pivoted and positioned such that tubular segment 51 is substantially aligned vertically with the tubular string 3 being held by the spider 14. It should be appreciated that during the alignment process, of tubular segment 51, tong 34, when utilized, will be positioned so as to also grip the tubular segment 51. Pickup arm 22 may then extend, retract, or pivot as necessary in order to stab tubular segment 51 into the tubular sting 3 being held in position by spider 14. It should be appreciated by those in the art that the stabbing operation of tubular segment 51 into the tubular string may be achieved in a variety of ways, including but not limited to, the telescoping extension of arm 22 or the lowering of arm 22 by the traveling block, such as the traveling block 11 of FIG. 1. After tubular segment 51 has been successfully stabbed into the casing string 3, tong 34 will engage the tubular segment 51 and threadedly connect tubular segment 51 to the casing string 3.

FIG. 4 illustrates, in greater detail, the elevator 32. Preferably, elevator 32 comprises an attachment member 48 which attaches elevator 32 to pickup arm 22. This attachment can be of any means including, but not limited to, welding, pinning, screwing, bolting, or other similar mechanical means as well as being integral with pickup arm 22. Cylinders 46 will allow the elevator 32 to pivot at least in a horizontal plane with respect to the pickup arm 22. Preferably two cylinders 46 will be utilized, however, the utilization of less than two cylinders 46 or the utilization of more than two cylinders 46 are within the scope of this invention. It should be appreciated that instead of utilizing cylinder or cylinders 46, a linear actuator, having a gear driven arm, may replace both of the cylinder(s) 46 and the attachment member 48. It should be further appreciated that in such an embodiment utilizing a linear actuator, the linear actuator would be connected by conventional means to arms 49. Cylinders 46 are preferably hydraulic cylinders but may also be pneumatic, electric, hydroelectric or any combination thereof. Preferably, the cylinders 46 will be attached to arms 49 and will allow the pivotation of the arms 49. Arms 49 will be preferably attached to the elevator gripping body 32*a* at connections 42*a*. It should be understood that the elevator 32 is an assembly and that when reference, herein, is made to elevator 32 it is meant to include the elements of the elevator 32 although the actual tubular 3, 51 gripping is within the elevator body 32*a*.

Preferably, elevator 32 is connected so as to allow the elevator 32 to pivot. Preferably, elevator 32 can pivot about connections 42*a* and 42*b*. The connections 42*a*, 42*b* are positioned so as to be slightly off the centerline CL of the elevator body 32*a*, thus allowing the weight of the elevator 32 to cause the elevator 32 to pivot downwardly when elevator doors 40 are opened. It should be appreciated that the pivotal connection of elevator 32 can be by any means, including conventional means such as hinges, pins, and the like. Preferably, elevator doors 40 are hydraulically operated. When the doors 40 open, the weight of the doors 40 will cause the elevator 32 to pivot or swing downwardly. The hydraulic operation of the elevator doors 40 can be achieved through the use of pistons or other cylinders (not illustrated). It should be appreciated that the hydraulic operation of doors 40 can also be pneumatic, electro pneumatic, electro hydraulic, electric, or any combination therein. Thus as elevator 32 pivots, elevator doors 40 will be open to allow elevator 32 to be positioned around tubular segment 51. Preferably, the elevator doors 40 are hinged about connections 44*a* and 44*b*. The hinged connections 44*a*, 44*b* can include, but not be limited to, pins, bolts, screws, rivets, pistons, and any other device that would allow the elevator doors 40 to pivot so as to create a large enough opening to allow the elevator 32 to substantially enclose and grip a tubular segment 51. The elevator doors 40 can be closed to substantially enclose tubular segment 51, either manually or automatically. Automatic closure could include hydraulic, pneumatic, electrical, or any combination thereof. It should be appreciated that although this embodiment illustrates and describes the elevator 32 as having two doors 40, any equivalent structure, such as but not limited to, one door or some other mechanism that would allow the entry of a tubular segment 51 into the elevator 32 and retain such tubular segment 51 within the elevator 32, can be substituted and is intended to be within the scope of this invention.

When the elevator doors 40 are closed, the elevator 32 will substantially enclose the tubular segment 51 and will grip the tubular 51. Elevator 32 can then be pivoted back into the a position substantially perpendicular to a plane parallel to the pickup arm 22. As the pickup arm 22 begins to move, the elevator 32 will more positively engage and grip the tubular segment 51. The pickup arm 22, as it is being lifted by the rig drive system, will begin to pivot in order to align the gripped tubular 51 with the wellbore 13 and the elevator 26 (see FIG. 3—elevator 32 in position to grip and pick up the tubular 51 and FIG. 2—elevator 32 aligning the picked up tubular 51 with the elevator 26 and the wellbore 13). It should be understood that elevator 32 is spring closed and hydraulically open. Therefore, even with a loss of hydraulic power, the elevator 22 will not drop the tubular segment 51.

As illustrated in FIG. 4, the elevator 32 further comprises cam followers 52, which allow for gripping the tubular segment 51 and allow the tubular segment 51 to rotate during coupling or uncoupling operations of the tongs. It should be understood that the cam followers are well known in the art, for example, in U.S. Pat. Nos. 6,330,911, 5,566,769, 5,291,808, and 5,144,868, and need not be further discussed here in. It should be appreciated that although elevator 32 is described herein as a hydraulic elevator or a single joint elevator, any number of gripping devices can be used without being viewed as a limitation thereof.

In another embodiment, illustrated in FIGS. 5 and 6, the pickup arm 22 can be attached to the drive unit 10*a*. It should be appreciated that the pickup arm 22, illustrated in FIGS. 5 and 6 could be longer than the pickup arm 22 illustrated in FIGS. 2 and 3 due to the attachment of the pickup arm 22 further above the elevator 26. However, such length can also be compensated by telescoping of pickup arm 22. It should be understood that when pipe segment 51 is a large diameter tubular, each tubular segment is very heavy, thus making the tubular string 3 heavy as well. In such a case, it may be preferable to use the top drive 10 instead of attaching the pickup arm 22 to sub 20 due to the heavy side load which occurs due to the heavy weight of a large diameter tubular segment 51. It should be appreciated that some rig owners or top drive owners may fear damage to the top drive from such a side load. Therefore, the embodiment illustrated herein in FIGS. 5 and 6 may be preferred with the large diameter tubular segment 51. Preferably, this embodiment would be removably attached to the drive unit 10*a* by an attachment support 41. The attachment support 41 would include a mounting bracket 42 which supports the arm 22. Preferably, the pickup arm 22 would be attached to the mounting bracket 42 with a pivotally rotating connection 24*a*. This connection 24*a* would allow the pickup arm 22 to have substantially the same range of movement as described herein above when the pickup arm 22 is mounted to a sub 20. It should be appreciated that the pickup arm 22 can be attached by conventional removable attachments, such as, pins, bolts, welding, clamps, bearings, and any other feature that would allow moveable attachment. It should be further appreciated that the mounting bracket 42 can be attached to the drive unit 10*a* in any conventional manner including, but not limited to, pins, bolts, welding, clamps, bearings, support bars/beams, and any other feature that would rigidly, yet removably allow attachment to the drive unit 10*a*. It should be understood that although it is preferable that the pickup arm 22 be removably attached to the drive unit 10*a*, a permanent attachment is likewise within the scope of the instant invention. Preferably, the pickup arm 22 is pivoted about connection 24*a* by one or more cylinders 28*a*. It should be understood that the pistons 28*a* may be hydraulic, pneumatic, electric, or any combination thereof. If should further be understood that the movement of pickup arm 22 can be achieved by means other than the pistons illustrated herein and should not be viewed as a limitation thereof. FIG. 6 illustrates the pickup arm 22 in a position to pickup and move the tubular 51 into alignment with the elevator 26.

Figure 6A:
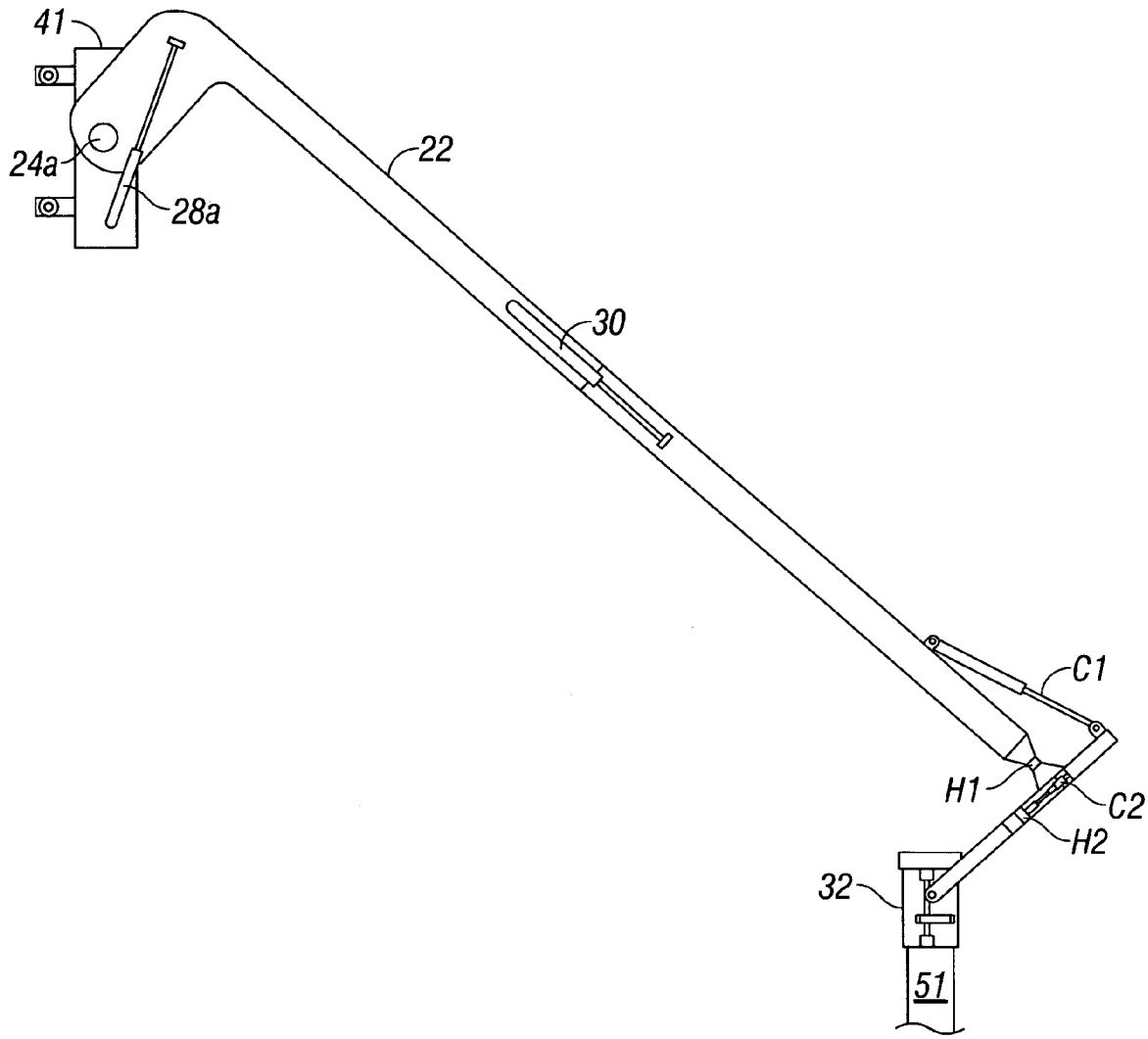
FIG. 6*a* illustrates an elevated side view of an embodiment of the running tool detailing the pivoting connections of the pick up elevator according to the present invention.

FIG. 6*a* illustrates an embodiment utilizing hinged connections H1, H2. Further illustrated, cylinders C1 and C2 allow elevator 32 to pivot about hinged connections H1, H2. It should be appreciated that when the distance between the V-door and the mouse hole are very small, elevator 32 may need to pivot to be able to align with and positively grip tubular segment 51 in order to pick up tubular segment 51. It should be appreciated that hinged connections H1, H2 are conventional and will not be described further herein. It should be further appreciated that cylinders C1, C2 can be hydraulic cylinders, pneumatic cylinders, electro hydraulic cylinders, electro pneumatic cylinders, electric cylinders or any other conventional cylinders which will allow the elevator 32 to pivot about hinged connections H1, H2.

Figure 7:
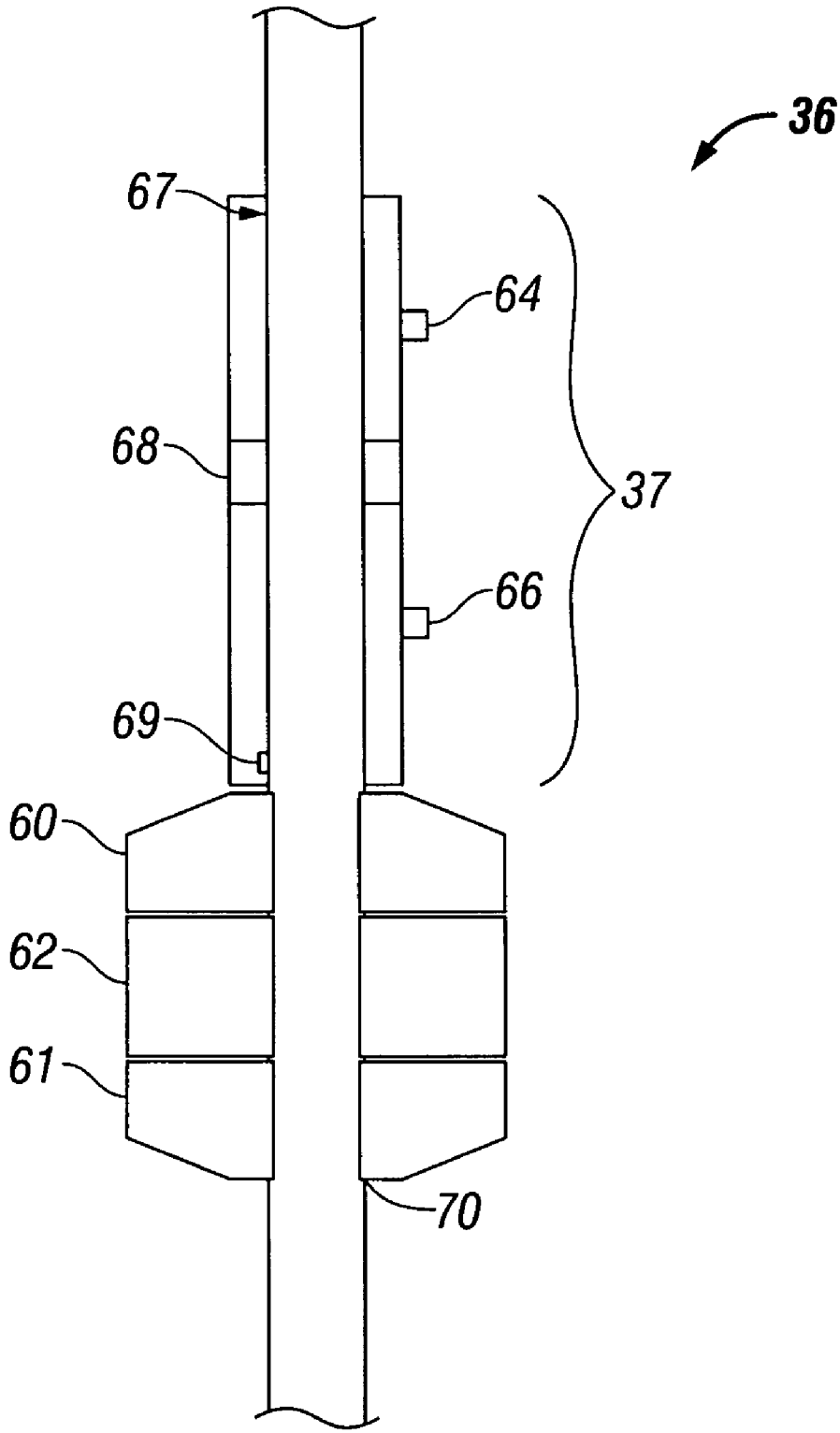
FIG. 7 illustrates a hydraulically energized packer according to the present invention.

Referring now to FIG. 7, there is illustrated an improved packer 36 according to the present invention. It should be understood that this packer can be used with tools other than that described herein. Packer 36 can be a single piece or a multi-piece unit. Preferably, packer 36 will comprise a support section 61 and a compressing section 60. Between the support section 61 and the compressing section 60 is a compressible band 62. The compressible band 62 is preferably a heavy duty urethane rubber. However, it should be appreciated that the compressible band 62 can be other polyurethane rubbers, rubbers, plastics, composites, and other malleable materials both metallic and non-metallic. A cylinder assembly 37 is preferably above the packer 36. It should be appreciated that the cylinder assembly 37 could be a hydraulic cylinder, a pneumatic cylinder, an electro-hydraulic cylinder, an electro-pneumatic cylinder, an electrical compression system, a mechanical compression system, or any combination thereof. It should be further appreciated that the cylinder assembly 37 could be below packer 36 or located so as to use extensions or the like to transfer a force onto the packer elements 60, 61. It should still further be appreciated that the position of the compressing section 60 and the support section 61 can be reversed from that illustrated in the figures or for both sections 60, 61 to transfer compressive forces onto the compressible band 62.

Cylinder assembly 37 further comprises at least two hydraulic connections 64, 66. It should be understood that if the power, other than hydraulic power is supplied to the connections 64, 66, the connections 64, 66 could still be used to facilitate the actuation of the cylinder assembly 37. They may be repositioned, or they may be eliminated depending on the exact type of power utilized for the cylinder 37 actuation. Preferably one of the connections 64, 66 would be used to facilitate the actuation of cylinder assembly 37 and the other connection 64, 66 would be utilized to deactivate the cylinder assembly 37. The cylinder assembly 37 further comprises seals 67, above connection 64, and seals 69 below connection 66. It should be understood that the seals 67, 69 are conventional seals used in cylinder/piston assemblies. When assembly 37 is activated, preferably, a piston 68 will force the cylinder assembly 37 downward and exert a force on at least one of the packer elements 60, 61 to compress the compressible band 62. As the compressible band 62 is compressed it will expand to fit and seal against the internal bore of a tubular into which it is inserted.

When it is desired to remove packer 36 from the interior of a tubular joint such as a joint of casing, energy such as but not limited to, hydraulic power, is transmitted through one of the connections 64, 66. It should be understood that when one of the connections 64, 66 is used to activate the cylinder assembly 37, the other connection would be used to deactivate the cylinder assembly 37. The compressive load is removed from the compressible band 62. The packer 36 can then be removed from the tubular into which it has been inserted. It should be appreciated that when the compressible band 62 is of a material with sufficient elastic memory, the compressible band 62 will return to substantially the same configuration as it had been prior to the exertion of compressive forces by the cylinder assembly 37. It should be appreciated that other means of setting the packer 36 including, but not limited to, a mechanical setting is within the scope of this invention.

In operation, the present device may operate in the following sequence. However, it should be understood by those in the art that the steps described herein may be altered and should not be viewed as a limitation thereof. As described hereinabove, the pickup arm 22 is extended and pivoted such that elevator 32 can grip and pickup a tubular segment 51. Preferably, elevator 32 can pivot so as to enclose the tubular segment 51 regardless of the horizontal/vertical relationship between the elevator and the tubular segment 51. The pickup arm 22 is moved in a substantially vertical direction away from the rig floor 12. The upward movement of the pickup arm 22 and consequently elevator 32, will cause elevator 32 to positively grip the tubular segment 51. As the pickup arm 22 moves upwardly, it will begin to pivot so as to position the tubular segment 51 in a substantially vertical position and into alignment with the borehole 13 and the elevator 26. Preferably, a tubular string is being held in place by a spider 14. The tubular segment 51 is then aligned with the tubular string (which is in the borehole 13) and the elevator 26. The pickup arm 22 and consequently the tubular segment 51 is manipulated, in an upwards and/or downwards direction to engage an end of the tubular segment 51 with the tubular string 3. The tubular segment 51 is then engaged by tong 34 (or other conventional tongs if tong 34 is not utilized) and preferably is threadedly coupled to the tubular string 3. It should be understood that while the tong spins the tubular segment 51, during the coupling operation, elevator 32 maintains a positive grip on the tubular segment 51 thus allowing the rotation, via the cam followers 52, but preventing any substantial vertical movement of the tubular segment 51. It should be appreciated that as tubular segment 51 is threadedly coupled to the tubular string 3 that there must be compensation for the weight of the tubular segment 51 as it is being threaded together. Preferably, this weight compensation is achieved using controls on the telescoping pistons 30. Preferably, a pressure gauge is connected by conventional means to cylinder(s) 30. Thus, as the tubular segment 51 is coupled to the tubular string 3 the pressure on the hydraulic gauge will rise as the threading of the joint of the tubular segment 51 creates an additional load on the arm 22 and thus on cylinder(s) 30. To compensate for this raise in pressure due to the load from tubular segment 51, pressure should be bled off from one side of the cylinder(s) 30 to the other side, such that the arm 22 actually extends as the tubular segment 51 is threaded into the tubular string 3. It should also be understood that when using a conventional single joint elevator it is possible to utilize a conventional single joint compensator, which is well known in the art and will not be further discussed herein. After the tubular segment 51 has been threadedly engaged with the tubular string 3 (being gripped by the spider 14), the elevator 32 releases its grip of the tubular segment 51.

Next, elevator 26 is lowered to a position allowing it to grip the tubular segment 51 and thus the tubular string 3 now coupled to the tubular segment 51. As the elevator 26 is being lowered, the pickup arm 22 preferably begins to pivot in a direction away from the centerline of the elevator 26 and the tubular segment 51. It should be understood that this pivoting is necessary to move the pickup arm 22 so as to prevent any contact between the pickup arm 22 and any rig personnel or rig equipment. As the elevator 26 is lowered over tubular segment 51, the guide 38 is inserted into tubular segment 51. If the running tool is of an embodiment employing a packer 36, the elevator 26 will lower to a position where the packer 36 is not fully inserted, or partially into the tubular segment 51. It should be understood by those in the art, that packer 36 will be utilized to plug the tubular 51 top end when it is necessary to have fluid circulation during the tubular running operation. When elevator 26 has been lowered to a certain predetermined distance along the vertical axis of tubular segment 51, elevator 26 will then grip tubular segment 51. Preferably, spider 14 will then release the tubular string 3, which is threadedly engaged with tubular segment 51. Tubular segment 51 and thus the tubular string 3 will be supported by elevator 26. At this point, elevator 26 will lower the tubular string 3 and tubular segment 51 into the bore hole or well bore 13. It should also be appreciated that elevator 26 can be of a variety of conventional elevators including, but not limited to, internal elevators such as are exemplified in U.S. Pat. Nos. 6,309,002 and 6,431,626. Still further, it should be appreciated that any other elevators or gripping devices, not necessarily just conventional devices, can be used in place of, or in addition to, the elevator 26 without departing from the scope of this invention.

If fluid circulation is required during the lowering of the tubular string 3, the elevator 26 will be lowered so as to allow the packer 36 to be fully inserted, some predetermined distance into the tubular segment 51. It should be appreciated that if circulation becomes necessary after the elevator 26 has gripped the tubular string 3 and begin lowering it, the spider 14 can again engage and grip the tubular string 3 and thus allow the elevator 26 to be lowered so as to position the packer 36 within the tubular segment 51. The packer 36 may then be activated, thus sealing the bore of the upper end of the tubular string 3 (i.e. the connected tubular segment 51). This sealing of the tubular string bore, allows fluid to be pumped through the center bore 80 of the packer 36 into the tubular string 3 and circulated to wash out cuttings or otherwise help the tubular string 3 be lowered.

It should be understood, by those skilled in the art, that if the tubular segment 51 being picked up is the first segment of a tubular string, then the pickup arm 22 will guide/stab this initial tubular segment 51 directly into the spider 14. At that point there will be no tong operation required and the pickup arm 22 can release its grip and allow the elevator 26 to be lowered over the tubular segment 51 as the pickup arm 22 is manipulated out of the way for the lowering elevator 26. It should be appreciated that the elevator 26 may be an external or internal elevator. If utilizing a conventional internal elevator (not illustrated), the operation would be substantially the same except that the gripping of the tubular segment 51, by the elevator 26, would be from the inside diameter of the tubular segment 51.

It should be understood that the power controls for the cylinders which control the extension, retracting, pivoting, and other movements of the pickup arm 22 are preferably digital controls. Thus, the cylinders can be programmed with stops tailored for use on specific rigs. Therefore, the stops will prevent the pickup arm 22 from colliding with or contacting the rig or rig equipment.

Preferably, when the instant running tool is employed, the drive unit 10 is disabled as to rotational capabilities, particularly when the apparatus is attached directly to a sub 20. In an alternative embodiment, as illustrated in FIG. 8, a special connection is utilized which would translate rotational power from the drive unit 10 directly to the tubular segment 51 (and the tubular string 3 when both are coupled together) without rotating the pickup arm 22. In this configuration sub 20 is prevented from rotating by anti-rotation plate 72. The anti-rotation plate 72 can be connected to the bails or otherwise connected in a conventional manner so as to prevent any rotational movement of sub 20. The top drive sub is then directly connected to pipe sub 73. Pipe sub 73 passes through pipe sub 20 and is not directly connected to pipe sub 20. A special pinned box connection 74, connects pipe sub 73 to the tubular segment 51. This connection 74 allows sub 73 to transmit rotational power from the drive unit 10 directly to the tubular segment 51 and thus to the tubular string 3. It should be appreciated in this configuration that elevator 26 and spider 14 are open. Thus, the weight of the casing string 3 and the connected tubular segment 51 is being held by the top drive 10. It should be further appreciated that in this configuration as the top drive supports the weight of the tubular string 3 and the connected tubular segment 51, the whole tubular string 3 can rotate. Thus, this configuration can be used when drilling with casing. It should be appreciated that drilling with casing is well known in the art, and need not be further discussed herein. However, the use of the instant invention allows for a tubular segment 51 to be connected to the tubular string 3 and to drill with the tubular string without having to add or take away equipment during the addition of tubular segments 51.

Figure 9:
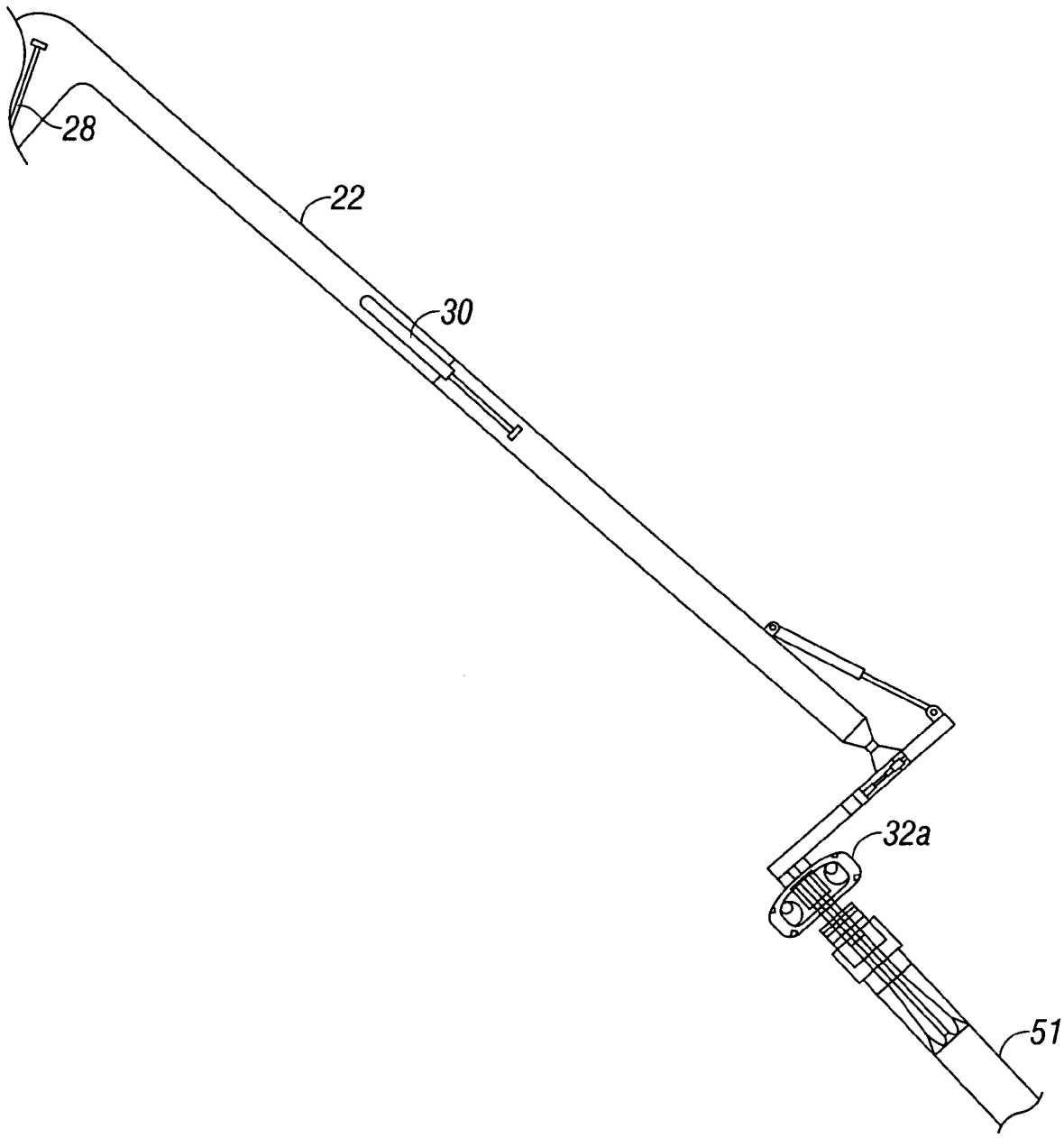
FIG. 9 illustrates an elevated side view, partially in cross-section, of an another embodiment of the running tool according to the present invention.

In another embodiment, illustrated in FIG. 9, the elevator 32*a* is an internal elevator that grips the tubular segment 51 from a position within the internal bore of the tubular segment 51. It should be appreciated that when utilizing an embodiment, such as illustrated in FIG. 9, that the hinged connections, such as H1, H2, of FIG. 6A, may be modified or added to so as to allow the range of motion necessary to stab the elevator 32*a* into the top internal bore of the tubular segment 51. It should be further appreciated that after the elevator 32*a* has fully engaged and gripped the tubular section 51, the remaining sequence of operation would be substantially the same in respect to moving the tubular section 51 into alignment with the elevator 26, the tubular string 3, and the borehole 13. Examples of such internal elevators can be found exemplified in U.S. Pat. Nos. 6,309,002 and 6,431,626.

It will be understood that certain features and sub-combinations are of utility and may be employed without reference to other features and sub-combinations. This is contemplated by and is within the scope of the claims. It may be seen from the preceding description that a novel tubular running tool and method have been provided. Although specific examples may have been described and disclosed, the invention of the instant application is considered to comprise and is intended to comprise any equivalent structure and may be constructed in many different ways to function and operate in the general manner as explained hereinbefore. Accordingly, it is noted that the embodiments described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A sub-assembly of a tubular running system comprising:
a rig driving mechanism;
at least one sub in communication with said rig driving mechanism;
an arm pivotally mounted to said at least one sub, wherein said arm pivots about at least one point positioned on at least a portion of said sub;
said pivotally mounted arm comprising at least one telescoping section; and
said arm comprising, at an end distal from said pivotal mounting, a gripping apparatus, wherein said gripping apparatus is fixedly secured to said distal end, and wherein pivoting of the moveable arm moves the gripping apparatus between a raised position for gripping a tubular segment in a substantially horizontal orientation and a lowered position for gripping the tubular segment in a substantially vertical orientation.

2. The tubular running system of claim 1 wherein said rig drive mechanism is a top drive assembly.

3. A sub-assembly of a tubular running system comprising:
a top drive assembly;
at least one sub connected to said top drive assembly;
an arm having a channel-shaped profile having first and second ends, said first end being pivotally mounted to said at least one sub, wherein said channel-shaped profile comprises at least two interior angles; and
a gripping apparatus fixedly secured to the second end of the arm, wherein pivoting of the moveable arm moves the gripping apparatus between a raised position for gripping a tubular segment in a substantially horizontal orientation and a lowered position for gripping the tubular segment in a substantially vertical orientation.

4. A tubular running system comprising:
a rig drive mechanism;
an arm pivotally and attachably mounted to said rig drive mechanism;

said pivotally mounted arm comprising at least one telescoping section;

said arm having mounted thereon at an end distal from said pivotal mounting, a gripping apparatus fixedly secured to said distal end, wherein pivoting of the moveable arm moves the gripping apparatus between a raised position for gripping a tubular segment in a substantially horizontal orientation and a lowered position for gripping the tubular segment in a substantially vertical orientation.

5. A tubular running system comprising:

a drive mechanism;

a moveable arm comprising a first end in communication with the drive mechanism and a second end, wherein the moveable arm is pivotally moveable with respect to the drive mechanism; and a gripping apparatus fixedly secured to the second end of the moveable arm, wherein pivoting of the moveable arm moves the gripping apparatus between a raised position for gripping a tubular segment in a substantially horizontal orientation and a lowered position for gripping the tubular segment in a substantially vertical orientation.

6. A tubular running system comprising:

a drive mechanism;

a moveable arm in communication with the drive mechanism, wherein the moveable arm is pivotally moveable with respect to the drive mechanism, and wherein the moveable arm comprises a channel-shaped profile comprising at least two interior angles for positioning a tubular segment engaged with the moveable arm beneath the drive mechanism; and a gripping apparatus fixedly secured to the moveable arm, wherein pivoting of the moveable arm moves the gripping apparatus between a raised position for gripping a tubular segment in a substantially horizontal orientation and a lowered position for gripping the tubular segment in a substantially vertical orientation.

* * * * *